US012371863B2

(12) United States Patent
Arnold

(10) Patent No.: US 12,371,863 B2
(45) Date of Patent: Jul. 29, 2025

(54) APPARATUS AND METHOD FOR CREATING A MUSICAL ROAD

(71) Applicant: Tim Arnold, Auburn, AL (US)

(72) Inventor: Tim Arnold, Auburn, AL (US)

( * ) Notice: Subject to any disclaimer, the term of this patent is extended or adjusted under 35 U.S.C. 154(b) by 735 days.

(21) Appl. No.: 17/606,664

(22) PCT Filed: Apr. 29, 2020

(86) PCT No.: PCT/US2020/030489
§ 371 (c)(1),
(2) Date: Oct. 26, 2021

(87) PCT Pub. No.: WO2020/223360
PCT Pub. Date: Nov. 5, 2020

(65) Prior Publication Data
US 2022/0162817 A1 May 26, 2022

Related U.S. Application Data

(60) Provisional application No. 62/840,053, filed on Apr. 29, 2019.

(51) Int. Cl.
*E01F 9/529* (2016.01)
*E01C 23/18* (2006.01)

(52) U.S. Cl.
CPC ..... *E01F 9/529* (2016.02); *E01C 23/185* (2013.01)

(58) Field of Classification Search
CPC ..... E01F 9/529; E01C 23/185
USPC ..... 404/16, 17, 84; 340/437, 905; 181/142
See application file for complete search history.

(56) References Cited

U.S. PATENT DOCUMENTS 4,211,366 A 7/1980 Czarnota
4,490,069 A * 12/1984 Cushman ..... E01F 9/529 404/15
4,515,499 A * 5/1985 Furiate ..... E01F 9/529 404/6
5,860,764 A * 1/1999 Roberts ..... E01C 19/236 404/93
5,929,787 A * 7/1999 Mee ..... G08G 1/07 340/908
6,014,595 A * 1/2000 Kobayashi ..... E01F 9/529 701/484
6,256,374 B1 * 7/2001 Tomasetti ..... A61B 6/464 378/98.2

(Continued)

OTHER PUBLICATIONS

PCT/US20/30489, International Search Report and Written Opinion, dated Jul. 27, 2020, 21 pages.

*Primary Examiner* — Raymond W Addie
(74) *Attorney, Agent, or Firm* — Bradley Arant Boult Cummings LLP; Jacob W Neu; Alex H Huffstutter

(57) ABSTRACT

An apparatus 10 and method is disclosed for creating one or more notes as a car 14 drives over the apparatus 10 on a road surface 12. The apparatus 10 can include a first strip 16 of durable material having a length 58 and a width 52; and a first plurality of recesses 20 defined in the first strip 16, each of the first plurality of recesses 20 extending across a portion of the width 52 of the first strip 16; wherein the first plurality of recesses 20 are spaced along the length 58 of the first strip 16 a first distance 24 from one another, the first plurality of recesses 20 producing a first note when the first strip 16 is placed on the road surface 12 and the car 14 drives over the length 58 of the first strip 16.

20 Claims, 6 Drawing Sheets

(56) References Cited

U.S. PATENT DOCUMENTS

| | | | | |
|---|---|---|---|---|
| 7,281,878 | B2 * | 10/2007 | Schulz | E01C 9/00 404/71 |
| 7,625,152 | B2 * | 12/2009 | Swamidass | E01F 9/529 404/15 |
| 7,731,448 | B2 * | 6/2010 | Fillie | E01F 9/529 404/15 |
| 7,736,087 | B1 | 6/2010 | Mettler et al. | |
| 8,142,100 | B2 * | 3/2012 | Hanson | A01K 29/00 116/63 R |
| 9,234,960 | B1 * | 1/2016 | McIntosh | E01F 9/529 |
| 2003/0026655 | A1 | 2/2003 | Schmidt | |
| 2003/0194271 | A1 | 10/2003 | Solon | |
| 2005/0031412 | A1 | 2/2005 | Loader et al. | |
| 2011/0048842 | A1 | 3/2011 | Zeleny | |
| 2015/0030390 | A1 | 1/2015 | Brown et al. | |
| 2015/0110554 | A1 * | 4/2015 | Mettler | E01F 9/529 404/15 |

* cited by examiner

APPARATUS AND METHOD FOR CREATING A MUSICAL ROAD

PRIORITY

This application claims the benefit of U.S. Provisional Patent Application No. 62/840,053 filed Apr. 29, 2019 entitled APPARATUS AND METHOD FOR CREATING A MUSICAL ROAD, which is hereby incorporated by reference in its entirety.

TECHNICAL FIELD

The present disclosure relates generally to the creation of vibrations or musical notes on a road as a car is traveling across the road.

BACKGROUND ART

A musical road is a creation of sound caused by placing a series of ridges or gaps on a road surface in the wheel path of an automobile. In its crudest form, this is commonly found as "rumble strips" which alert the driver to slow down or correct their course when they veer off the road. Through dutiful calculation of the width and number of strips, this sound phenomenon can recreate a series of tones that mimic a melody, verily "hummed" aloud by the tires of the vehicle as they are induced to vibrate at specific frequencies by the ridges or gaps of the road surface.

The first known musical road was created by a pair of Danish artists in 1995. This "asphaltophone" was created using raised pavement markers, seemingly placed painstakingly by hand, to produce a short melody. Since then, many others have been created in Japan, South Korea, the Netherlands and the United States. With the exception of the original "asphaltophone", all other musical roads appear to have been created by cutting or pressing grooves into the surface of the road.

These roads have been successful in attracting attention from tourists and local drivers, but also have been proven to help safely control driving speeds in previously dangerous locations. Unfortunately, many reports exist that these musical roads deteriorate in short time, likely due to wear on the road surface as well as impairment from dirt and debris.

What is needed then are improvements in musical road apparatuses and methods.

SUMMARY OF THE INVENTION

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

One aspect of the present disclosure is an apparatus including a varied selection of one or more strips of DOT-approved material utilizing a durable polymer backed with a strong adhesive designed for installation on a standard road surface. The apparatus can be manufactured and assembled in numerous variations with high precision to recreate any musical note of the standard scale. Such notes can be sequenced to create a desired melody in some embodiments. Ordered to length, the one or more strips with corresponding notes can be laid out on a road in a short and easy installation process and can last for many years under normal driving and weather conditions.

Having such an apparatus can help provide for the quick and efficient creation of a musical road on a road surface as individual raised sections and/or recesses do not need to be created or installed manually on the road surface. Instead, strips of polymer material with defined recesses in them can be prefabricated offsite, with computer-controlled technology in some embodiments, which can help increase the accuracy of the placement of the individual recesses in the strips and reduce human error during installation. An apparatus manufactured in this manner can help increase the accuracy and quality of sound generated by a musical road. Additionally, having a raised structure placed on the road can help reduce the amount of dirt and debris deposited in the recesses formed, which can help increase sound quality and longevity of the musical road.

Another aspect of the present disclosure is an apparatus for creating one or more notes as a car drives over the apparatus on a road surface, the apparatus including a first strip of durable material having a length and a width. A first plurality of recesses can be defined in the first strip, each of the first plurality of recesses extending across a portion of the width of the first strip. The first plurality of recesses can be spaced along the length of the first strip a first distance from one another, or spaced with a first distance between successive recesses. The first plurality of recesses can produce a first note when the first strip is placed on the road surface and the car drives over the length of the first strip. In some embodiments, the first strip can have a thickness, and the first plurality of recesses can be a plurality of apertures, each aperture extending through the thickness of the first strip. In some embodiments, the first strip can be made of a flexible durable polymer material.

In some embodiments, the apparatus can include a second strip of durable material having a second length and a second width. A second plurality of recesses can be defined in the second strip, each of the second plurality of recesses extending across a portion of the second width of the second strip. The second plurality of recesses can be spaced along the second length of the second strip a second distance from one another, or spaced with a second distance between successive recesses of the second plurality of recesses, the second plurality of recesses producing a second note when the second strip is placed on the road surface and the car drives over the second strip. The first and second strips can be affixable to the road surface in an end-to-end fashion. In some embodiments, the apparatus can be installed on a road surface by affixing the first strip to the road surface and affixing the second strip to the road surface such that a rest spacing is formed between the first and second strips.

In some embodiments, each of the first plurality of recesses has a first recess width, each of the second plurality of recesses has a second recess width, and the ratio of the first recess width to the first distance is equal to the ratio of the second recess width of the second plurality of recesses to the second distance. In some embodiments, the first group of recesses each have a first recess width that is substantially equal to the first distance, and the second plurality of recesses each have a second recess width that is substantially equal to the second distance. In some embodiments, the first recess width and the second recess width are not equal to one another.

In some embodiments, the first strip includes a second plurality of recesses defined in the first strip, each of the second plurality of recesses extending across a portion of the width of the first strip, wherein the second plurality of recesses is spaced along the length of the first strip a second distance from one another, the second plurality of recesses producing a second note when the first strip is placed on the road surface and the car drives over the length of the first strip. As such, both pluralities of recesses can be defined on a single strip. In some embodiments, the first plurality of recesses and the second plurality of recesses are spaced apart from one another along the length of the first strip by a resting spacing.

In some embodiments, the first and second plurality of recesses can be alternatingly repeated along a length of the first strip such that alternating first and second notes are produced when the first strip is placed on the road surface and the car drives over the length of the first strip. In some embodiments, the first and second notes correspond to different notes on a diminished fifth chord or a diminished fifth internal.

In some embodiments, the first strip can include a bottom side, and the apparatus further includes an adhesive layer disposed on the bottom side of the first strip. The adhesive layer can include a strong but removable and non-destructive adhesive which can removed readily from the road surface without causing damage to the road surface. As such, the musical roads created by the apparatus disclosed herein can be temporary installations if desired.

Another aspect of the present disclosure is a method of creating a musical road or musical notes on a road surface including the steps of providing one of the various embodiments of the apparatus disclosed herein and affixing the apparatus to a road surface. A car can be driven over the apparatus at a desired speed to produce a one or more musical notes or tones. In some embodiments, a series or melody of notes can be produced as the car is driven over the apparatus. In some embodiments, all recesses are pre-formed in the apparatus prior to affixing the apparatus to the road surface, which can help reduce on-site installation time.

Another aspect of the present disclosure is an apparatus including a first strip of polymer material, the first strip including a first plurality of recesses defined in the strip, the first plurality of recesses spaced equally apart by a first distance which creates a first frequency corresponding to a musical note to be replicated by a car driving across the first plurality of recesses at a constant, predetermined speed. In some embodiments, the apparatus can include multiple strips of polymer material, each polymer strip having a corresponding plurality of recesses spaced apart by a corresponding distance to create a corresponding frequency for a musical note to be replicated by the car driving across the corresponding plurality of recesses. The strips can be placed in a desired succession or sequence to replicate a desired melody when a car passes over the entirety of the apparatus.

One objective of the present disclosure is to help provide an apparatus and method to create a musical road that can be less expensive, more durable and long-lasting, and can produce a cleaner, more refined sound when used. Certain improvements have been made in materials, design, and installation which can help scientifically enhance the quality of the sonic phenomenon. Such improvements can be utilized separately in different embodiments or in combination with one another. The apparatus disclosed herein can be used to quickly and conveniently create a musical road on the stretch of roadway.

Whatever the desired goal of a musical road—creating safer driving conditions, tourist attraction, celebration of local civic or corporate culture and traditions—a musical road can provide a unique, exciting, safety, and/or useful feature to a user or community. The apparatus described herein can help promote installation of a musical road with less cost, less labor, less waste, a smaller environmental impact and can be more accurate and more durable than previous musical roads.

Numerous other objects, advantages and features of the present disclosure will be readily apparent to those of skill in the art upon a review of the following drawings and description of a preferred embodiment.

MODES FOR CARRYING OUT THE INVENTION

Figure 1:
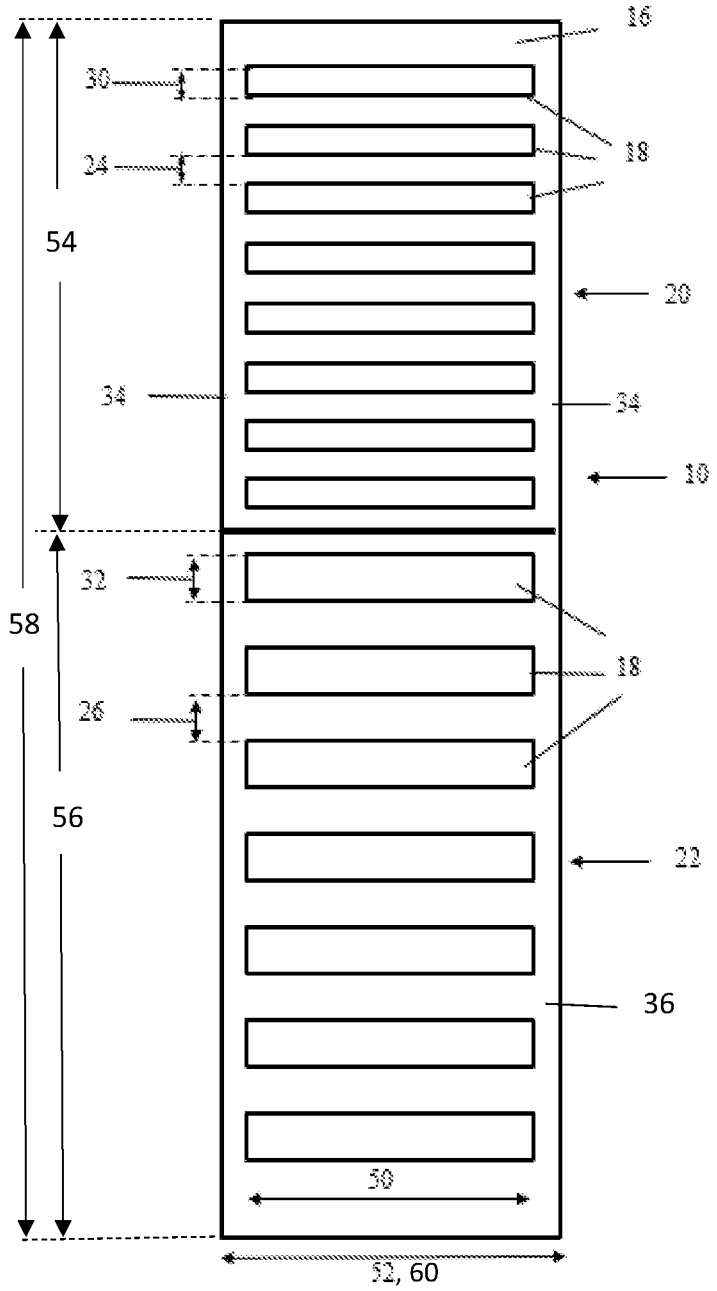
FIG. 1 is a top view of one embodiment of an apparatus for creating a musical road of the present disclosure having first and second strips of durable material with corresponding pluralities of recesses.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

In the drawings, not all reference numbers are included in each drawing, for the sake of clarity. In addition, positional terms such as "upper," "lower," "side," "top," "bottom," etc. refer to the apparatus when in the orientation shown in the drawing. A person of skill in the art will recognize that the apparatus can assume different orientations when in use.

Figure 2:
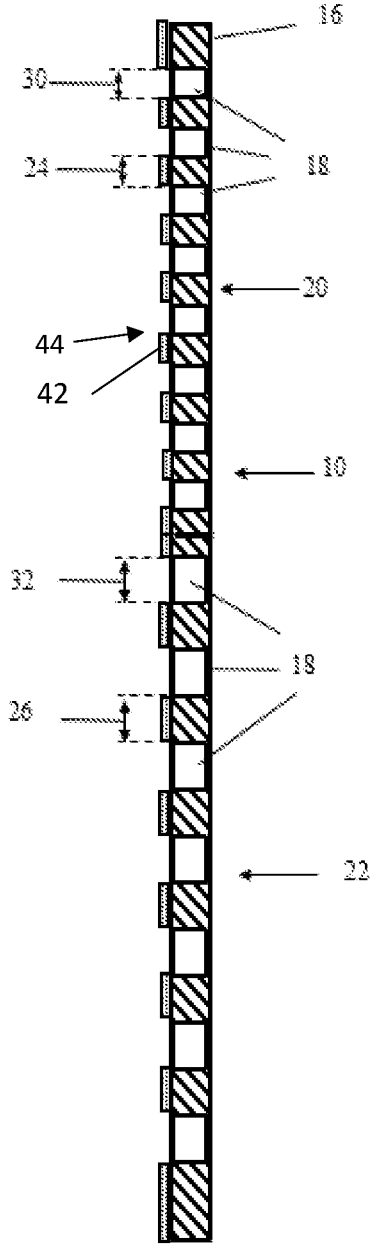
FIG. 2 is a side view of the apparatus of FIG. 1.

As shown in FIGS. 1-7, one aspect of the present disclosure is an apparatus 10 for creating one or more notes as a car 14 drives over the apparatus 10 on a road surface 12, the apparatus 10 including a first strip 16 of durable material having a length 54, 58 and a width 52. A first plurality of recesses 20 can be defined in the first strip 16, each of the first plurality of recesses 20 extending across a portion of the width 52 of the first strip 16. The first plurality of recesses 20 can be spaced along the length 58 of the first strip 16 a first distance 24 from one another, or spaced with a first distance 24 between successive recesses 20. The first plurality of recesses can produce a first note when the first strip 16 is placed on the road surface 12 and the car 14 drives over the length of the first strip 16. In some embodiments, as shown in FIG. 2, the first strip 16 can have a thickness, and the first plurality of recesses 20 can be a plurality of apertures, each aperture extending through the thickness of the first strip 16. In some embodiments, the first strip 16 can be made of a flexible durable polymer material. The durable strips 16 and 36 can be made from any suitable durable material that can withstand repeated impact from the wheel of a car, including but not limited to, polyethylene, polystyrene, polypropylene, PVC, rubber, poly acrylates, polyurethanes, or other hard or flexible plastics, metals, polymers, or synthetic materials.

Figure 6:
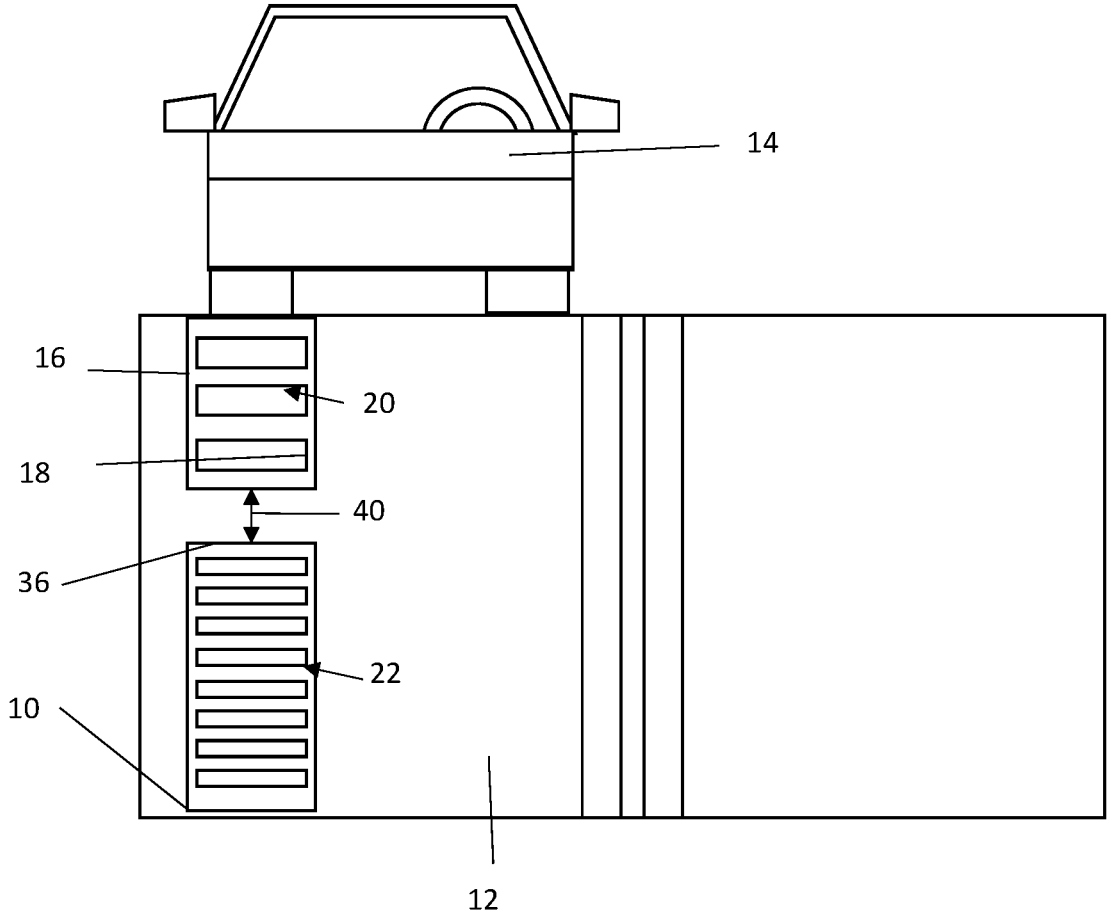
FIG. 6 is a front perspective view of the apparatus of FIG. 1 being driven over by a car with a resting space defined between the first and second strips of the apparatus.

In some embodiments, the apparatus 10 can include a second strip 36 of durable material having a second length 56 and a second width 60. In some embodiments, the width 52 of the first strip 52 and the second width 60 of the second strip 36 can be substantially equal. A second plurality of recesses 22 can be defined in the second strip 36, each of the second plurality of recesses 22 extending across a portion of the second width 60 of the second strip 36. The second plurality of recesses 22 can be spaced along the second length 56 of the second strip 36 a second distance 26 from one another, or spaced with a second distance 26 between successive recesses of the second plurality of recesses 22, the second plurality of recesses 22 producing a second note when the second strip 36 is placed on the road surface 12 and the car drives over the second strip 36. The first and second strips 16 and 36 can be affixable to the road surface 12 in an end-to-end fashion as shown in FIG. 6. In some embodiments, the apparatus 10 can be installed on a road surface 12 by affixing the first strip 16 to the road surface 12 and affixing the second strip 36 to the road surface 12 such that a rest spacing 40 is formed between the first and second strips 16 and 36.

In some embodiments, each of the first plurality of recesses 20 has a first recess width 30, each of the second plurality of recesses 22 has a second recess width 32, and the ratio of the first recess width 30 of the first plurality of recesses 20 to the first distance 24 is equal to the ratio of the second recess width 32 of the second plurality of recesses 22 to the second distance 26. In some embodiments, the first plurality of recesses 20 each have a first recess width 30 that is substantially equal to the first distance 24, and the second plurality of recesses 22 each have a second recess width 32 that is substantially equal to the second distance 26. In some embodiments, the first recess width 30 and the second recess width 32 are not equal to one another.

Figure 4:
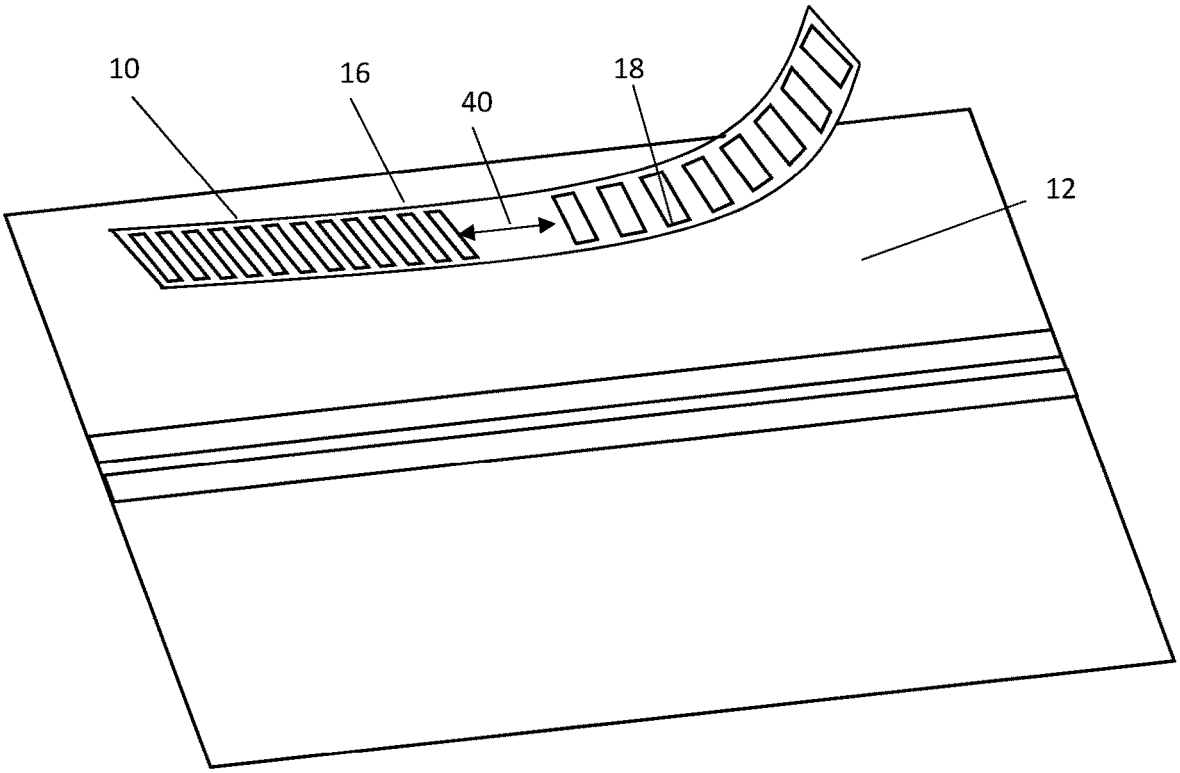
FIG. 4 is a perspective view of another embodiment of an apparatus for creating a musical road of the present invention being installed on a road surface.
Figure 5:
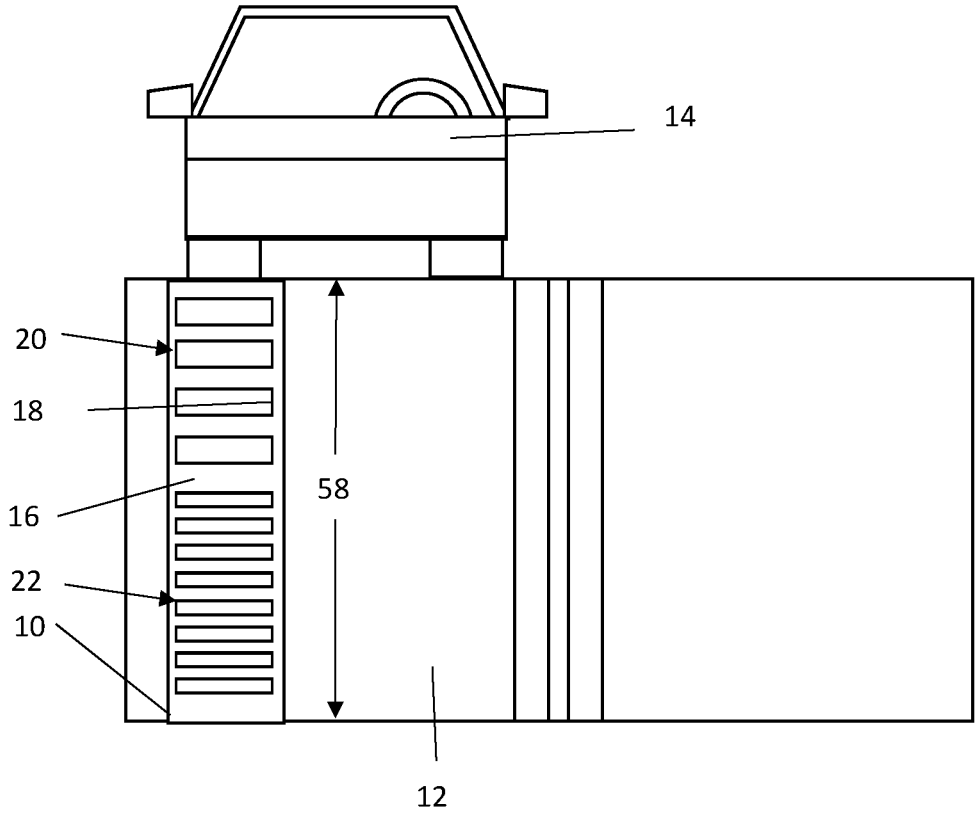
FIG. 5 is a front perspective view of the apparatus of FIG. 4 being driven over by a car.

In some embodiments, as shown in FIGS. 1, 4-5, the first strip 16 includes a second plurality of recesses 22 defined in the first strip 16, each of the second plurality of recesses 22 extending across a portion of the width 52 of the first strip 16, wherein the second plurality of recesses 22 is spaced along the length of the first strip 16 a second distance from one another, the second plurality of recesses producing a second note when the first strip 16 is placed on the road surface 12 and the car 14 drives over the length 58 of the first strip 16. As such, both pluralities of recesses 20 and 22 can be defined on a single strip 16. In some embodiments, the first plurality of recesses 20 and the second plurality of recesses 22 are spaced apart from one another along the length of the first strip 16 by a resting spacing 40. The resting space is a portion of the strip 16 without recesses where no sound or a substantially reduced sound is produced as a car 14 drives over the first strip 16. The resting space 40 signifies and corresponds to a rest in a desired melody produced by the apparatus 10.

Figure 7:
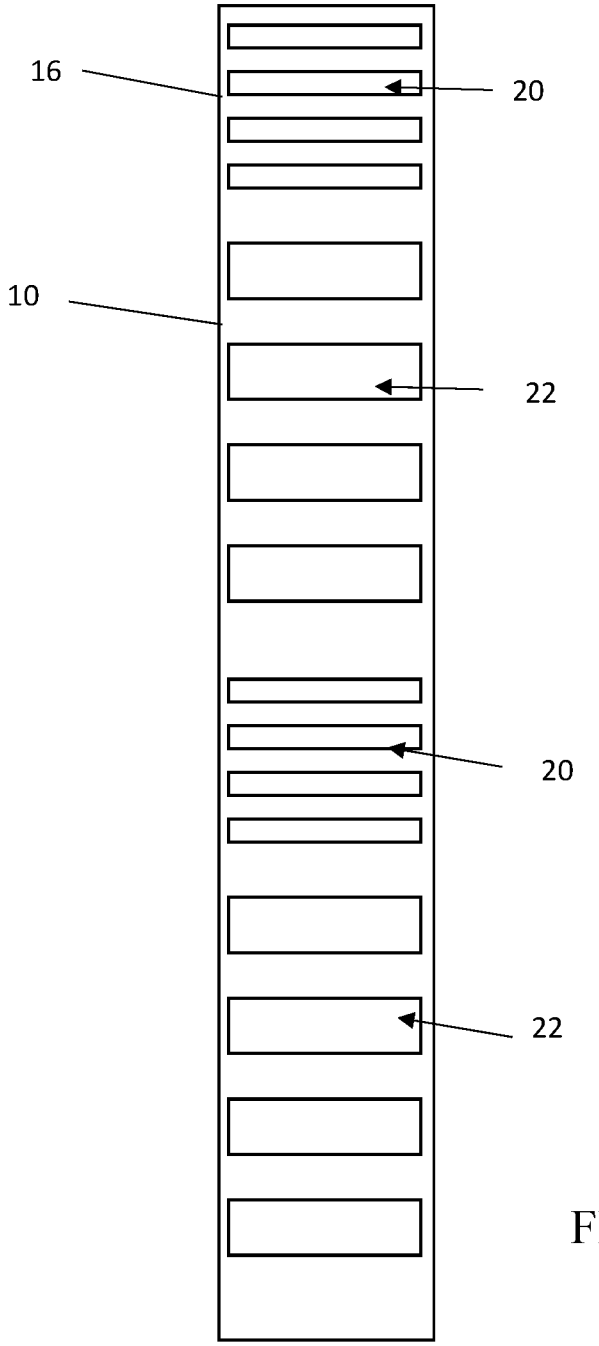
FIG. 7 is a top view of another embodiment of an apparatus for creating a musical road of the present disclosure including repeating first and second pluralities of recesses along a length of a strip of durable material.

In some embodiments, as shown in FIG. 7, the first and second plurality of recesses 20 and 22 can be alternatingly repeated along a length of the first strip 16 such that alternating first and second notes are produced when the first strip 16 is placed on the road surface and the car drives over the length of the first strip 16. In some embodiments, the first and second notes correspond to different notes on a diminished fifth chord or diminished fifth interval.

Referring now to FIG. 2, in some embodiments, the first strip 16 can include a bottom side 44, and the apparatus 10 further includes an adhesive layer 42 disposed on the bottom side of the first strip 16. The adhesive layer 42 can include a strong but removable and non-destructive adhesive which can be removed readily from the road surface without causing damage to the road surface. As such, the musical roads created by the apparatus 10 disclosed herein can be temporary installations if desired.

A car 14 can drive across the apparatus 10 affixed to the road surface 12, the apparatus 10 positioned on a normal wheel path of a vehicle on a road (see FIG. 5). Referring now to FIGS. 1 and 2, in some embodiments, the apparatus 10 can include a series of strips 16 and 36 of a durable polymer material, each strip 16 and 36 includes a corresponding plurality of recesses 18 defined in the strips 16 and 36, the corresponding plurality of recesses 18 each having a corresponding width 30 and 32 and spaced substantially equally apart at a corresponding distance 24 and 26 and repeating across the lengths 54 and 56 of the strips 16 and 36, the lengths 16 and 36 of the strips 16 and 36 determined by the duration of the note required and the desired speed of the vehicle 14. The dimension of the corresponding width 30 and 32 and corresponding distances 24 and 26 between successive recesses for the corresponding plurality of recesses 18 on any individual strip 16 or 36 will be calculated to create a desired frequency corresponding to a desired note being replicated by the vibration of the car tire as the car passes over the strips 16 and 36. Across the apparatus 10, different individual strips 16 and 36 can have corresponding pluralities of recesses 18 of varying dimensions depending on the desired note to be replicated by each strip. In some embodiments, each strip 16 and 36 can contain only one repeating recesses of the same width 30 and 32 and spaces or distances 24 and 26 between the recesses 18 to create a single note for a desired length of time. In some embodiments, the apparatus 10 would include multiple strip segments placed in succession to replicate a melody when a car passes over the entirety of the apparatus 10. Such an apparatus 10 would allow for long rolls of polymer strips corresponding to desired notes to be manufactured and then cut to length or customized as desired depending on the melody to be created, the cut strips being installed in a desired sequence on the road surface 12 to create the musical road.

In still other embodiments, as shown in FIGS. 4-5, a single strip 16 of polymer material can include two or more pluralities of recesses 20 and 22 defined therein, each plurality of recesses 20 and 22 including corresponding widths 30 and 32 and corresponding distances 24 and 26 between the recesses 20 and 22 to create a desired note to be replicated as described above. In such embodiments, multiple notes, or an entire melody, could be created on a single strip 16 to further ease installation of the apparatus 10 on the road surface 12.

The phenomenon of sound is created by a vibration reaching the ear. The qualities of the sound depend on the size of the vibration (aka, amplitude or volume) and the frequency of the vibration (aka, pitch or tone). The frequencies of different musical notes are measured in Hertz (number of vibrations per second) where the modern "equal tempered scale" is set by A=440 Hz (e.g., the string of a violin playing an A note will vibrate 440 times every second). The frequencies for a 2-octave selection of a common range of musical notes are featured in the table included herein.

Vibrations are made when a vehicle drives over a bump in the road. This may be a groove cut into the road or a ridge affixed to the surface of the road. Approximating the pitch of each note is based on manipulating the interval between the road features to replicate the corresponding frequencies for various notes.

For example, calculating values for a constant velocity of 45 mph (converted to 20.1168 meters/sec), with each desired note having a given frequency, the space between road features (or, "interval") is calculated as the wavelength using the formula: wavelength=velocity/frequency. See the following table:

| Note | Frequency (Hz) | Wavelength (cm) | Half-interval (cm) |
|---|---|---|---|
| $C_3$ | 130.81 | 15.379 | 7.689 |
| $C\sharp_3/D\flat_3$ | 138.59 | 14.515 | 7.258 |
| $D_3$ | 146.83 | 13.701 | 6.850 |
| $D\sharp_3/E\flat_3$ | 155.56 | 12.932 | 6.466 |
| $E_3$ | 164.81 | 12.206 | 6.103 |
| $F_3$ | 174.61 | 11.521 | 5.760 |
| $F\sharp_3/G\flat_3$ | 185 | 10.874 | 5.437 |
| $G_3$ | 196 | 10.264 | 5.132 |
| $G\sharp_3/A\flat_3$ | 207.65 | 9.688 | 4.844 |
| $A_3$ | 220 | 9.144 | 4.572 |
| $A\sharp_3/B\flat_3$ | 233.08 | 8.631 | 4.315 |
| $B_3$ | 246.94 | 8.146 | 4.073 |
| $C_4$ | 261.63 | 7.689 | 3.845 |
| $C\sharp_4/D\flat_4$ | 277.18 | 7.258 | 3.629 |
| $D_4$ | 293.66 | 6.850 | 3.425 |
| $D\sharp_4/3\flat_4$ | 311.13 | 6.466 | 3.233 |
| $E_4$ | 329.63 | 6.103 | 3.051 |
| $F_4$ | 349.23 | 5.760 | 2.880 |
| $F\sharp_4/G\flat_4$ | 369.99 | 5.437 | 2.719 |
| $G_4$ | 392 | 5.132 | 2.556 |
| $G\sharp_4/A\flat_4$ | 415.3 | 4.844 | 2.422 |
| $A_4$ | 440 | 4.572 | 2.286 |
| $A\sharp_4/B\flat_4$ | 466.16 | 4.315 | 2.158 |
| $B_4$ | 493.88 | 4.073 | 2.037 |
| $C_5$ | 523.25 | 3.845 | 1.922 |

As stated above, the table shows the distance between the road features or successive recesses (wavelength or interval) determined for replicating a desired musical note calculated here for a car travelling at a constant speed of 45 mph. For example, to create a middle-C ("C4") at a vehicle speed of 45 mph, ridges or grooves would be put on the road every 7.689 cm, vibrating the tire at the desired frequency of 261.63 Hz. Should a different speed be desired for the vehicle, then these wavelength calculations would be recalculated and found to be proportional to the vehicle speed; the slower the car speed, the shorter the interval to achieve a desired frequency, the faster the car speed, the longer the interval needed to achieve a desired frequency.

One significant improvement to previous musical roads researched is the optimization of a ratio of the width of recesses to the distance between such recesses in a given plurality of recesses designed to create a desired note. Other musical roads use ridges or grooves of a fixed width spread out in different intervals or with different spacing between the recesses to produce different musical notes. In such prior art devices, the ratio of the recess width to the spacing distance between the recesses varies from note to note and plurality of recesses to plurality of recesses, as the width of the recesses stays the same for all notes but the spacing between the recesses changes from note to note. In some embodiments of the present disclosure, the ratio of the recess widths 30 or 32 and the spacing distance 24 or 26 respectively between successive recesses can be maintained substantially constant across different pluralities of recesses replicating various notes. As such, in some embodiments, the widths 30 and 32 of the recesses in various plurality of recesses 20 and 22 respectively can vary proportionally to spacing distances 24 and 26 between successive recesses in different plurality of recesses 20 and 22 respectively.

According to the results of a detailed analysis of signal-to-noise ratio tests under differing variables, a road feature or recess that is exactly half of the width of the desired interval or wavelength for a designated note (aka, "half-interval") can help generate a more refined sound and can require a smaller amplitude to achieve a quality sound. In a half interval configuration, the recess width in a given plurality of recesses is equal to the spacing distance between the recesses for the given plurality of recesses. The increase in the quality of sound at this configuration may be due to the physical resemblance of a sound wave. Significantly, this improvement in sound quality allows for a smaller amplitude that is greatly beneficial to the "environmental noise" sometimes associated with musical roads. In some embodiments, the ratio between the recess width and the spacing distance between successive recesses can be maintained between 3:4 and 5:4 for all plurality of recesses in the apparatus 10. Improved Musical roads incorporating the benefits of the optimization of the ratio between the recess width and the spacing distance between recesses, and particularly the half-interval configuration, can help produce a quality, localized sound and therefore may not require as large of an amplitude or be as loud as prior conventional musical roads while still producing a quality sound. Incorporating these results into the design of the apparatus, in some embodiments each plurality of recesses in the apparatus 10 can be manufactured in a "half-interval" configuration wherein corresponding pairs of widths and spaces (24,30 and 26, 32) of recesses 20 and 22 respectively can be equal to each other and both adding up to the value of the corresponding wavelength for the corresponding musical note designated for that plurality of recesses 20 and 22.

For example, to create a strip of material that will generate an "A3" note, the recesses repeat in the interval or wavelength from the previous table of 9.144 cm (where: wavelength/2=half-interval). Therefore, a 4.572 cm recess is cut into the material, repeating itself after every 4.572 cm of material. This produces an equal, alternating pattern of material and recesses that closely resembles a sound wave. An additional benefit of this half-interval dimension is an increased strength and stability across the length of product, stronger and less flimsy during handling and application. In other embodiments, the recess width can range from 3.429 cm to 5.715 cm and vice versa for the distance between the recesses to produce width to distance ratios ranging from 3:4 to 5:4. This calculation could be repeated for other plurality of recesses design to produce varying notes having varying wavelengths.

Figure 3:
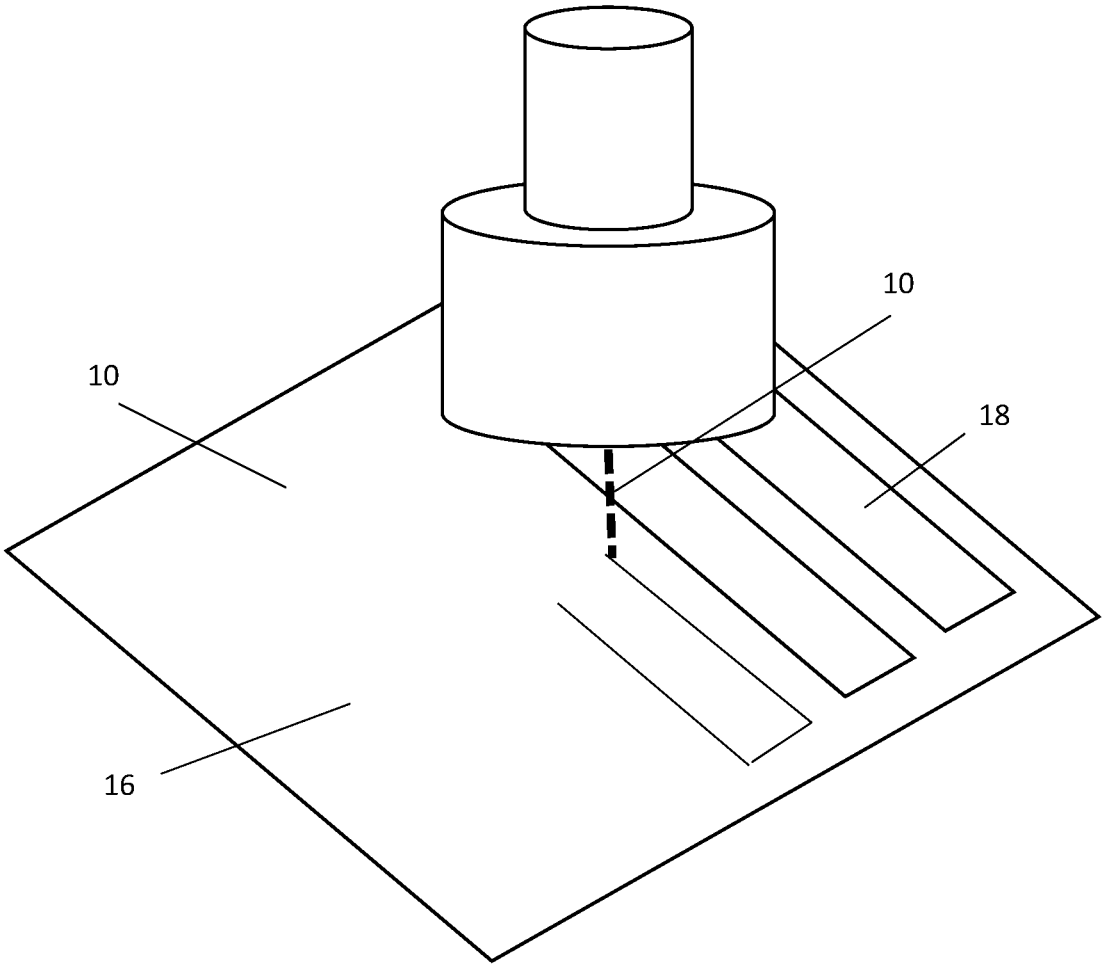
FIG. 3 is a perspective view of a plurality of recesses being pre-formed in strip of durable material using a laser cutter.

The recesses 18 in one embodiment can be formed in the strip 16 using a high-powered laser cutter (See FIG. 3). The strip 16 can be laid out flat and rectangular-shaped recesses 18 can be cut out of the material using a computer-controlled program in some embodiments. This process allows a mathematical precision (in some embodiments to the 1/1000th of a cm) to be "locked in" to the product, eliminating much of the potential for human error associated with installing individual ridges on a road or cutting individual recesses in the road, thus helping to improve the quality of the sound. After manufacturing the recesses in the half interval configuration or in a configuration with the width to distance ratio being between 3:4 and 5:4, a strip 16 can resemble a ladder with long, unbroken sidewalls 34 on the strip 16 of material along the edges and recesses 18 cut out in lengths 50 lesser than the overall width 52 of the material. A long strip with multiple pluralities of recesses, or cut strip segments with individual notes defined in them can be rolled back up and transported to the road site and laid out easily, requiring significantly less time for measuring and placement of each individual road feature.

In embodiments utilizing individual strip segments, once the recesses have been cut into the material, it can be relatively easy to lay the strip segments into place on the road surface 12 with the appropriate distance or rest spacings 40 between strips calculated as the musical "rests" between notes of the melody. Affixing the adhesive on each strip segment to the road, the strip segments are laid in the normal wheel path of the passenger-side tires of the vehicle. A short melody of just a few notes may have as many as 500 individual road features to create the musical road, so the accuracy of the manufacturing process and the ease of installation can help save a substantial amount of time, labor and potential for error. In some embodiments, there can be practically no cleanup and very little time required for cooling, curing or other processes, regular traffic can be resumed as soon as the apparatus installation is complete, which drastically reduces the time required to close the road for installation.

The apparatus disclosed herein can be produced by various other manufacturing techniques, including cutting, milling, extrusion, or injecting molding processes, including manual and automated manufacturing processes. The recesses, as opposed to being formed by cutting recesses into the strips, can also be formed by producing or forming raised ridges along the length of the strip of durable material to form recesses having widths and spacing between the recesses as previously described herein to form desired notes.

The process detailed above results in a long roll of material with a high-precision layout of road features that will create a sonic "hum" when driven over by any standard vehicle at a constant speed. Utilizing the fixed ratio measurement for recess width and spacing distance for each desired note and frequency, this process can be repeated to manufacture strips of material that will recreate any musical note required. Once a melody has been selected by the consumer, the only information required is the duration of each note and the space between notes. This is calculated simply by analyzing the melody and translating the timed duration of notes and rests into the lengths of road the vehicle will travel during that time. For example: 1 second@45 mph=66 feet. So, if the melody required an "F4" note that lasted one second, the customer could simply purchase 66 feet of product that was manufactured with a 2.88 cm "half-interval" or other fixed ratio interval of alternating material and recesses.

Repeating this method for every note in the song, a consumer could easily purchase strips corresponding to any musical note in any length required for that note's duration and lay them out on a road surface as instructed. Empty spaces between the notes are achieved by the normal road surface and the length required for the duration of those "rest notes" is calculated in the same manner as above. This value is measured as the distance between strips of product creating each note. In embodiments using a single strips 16 with numerous pluralities of recesses, the rest spaces can be lengths of the strip where no recesses are formed reduces vibrations made by the strip as the car travels over the resting spaces.

With the ability to create musical notes using different, corresponding fixed ratio and/or half-intervals, anyone with a short melody and a length of road at their disposal can now create a musical road. All the complicated mathematical equations have been done and there is no need for a large crew with lots of expensive and messy machinery to modify the road surface. This product is easy to install, low waste, environmentally friendly and manufactured using material already approved by the Department of Transportation.

One such application is worth detailing for its potential as a widespread safety product. A series of repeating intervals (for example, F # and C) could be arranged such that a vehicle driving across them would create a sonic phenomenon that closely mimics a siren. Similar to the alert system of many types of emergency and safety vehicles, most sirens around the world use a unique musical structure (tritone) of a diminished fifth (aka, an augmented fourth) that was originally called "the Devil's interval" in classical music of the Renaissance for its intentional dissonance and dark, discomforting sound. In other words, the first note produced by the first plurality of recesses and the second note produced by the second plurality of recesses when the car drives over the strip could produce notes corresponding to a diminished fifth chord or diminished fifth interval.

Most modern sirens use a tritone sound, although many countries use different notes. Fortunately, the design of this musical road application would allow variances in speed to retain a relative "diminished fifth" variance between notes regardless of speed, remaining effective at alerting drivers with the universally recognized sound of a siren. There is the potential for such a commercialization of the application to be utilized for use in both permanent settings (e.g., traffic alerts, school or hospital zones) and making use of the temporary, non-destructive characteristics of the application (e.g., construction zones and special events).

Another aspect of the present disclosure is a method of creating one or more notes as a car drives over a road surface, the method comprising the steps of preforming at least one plurality of recesses into a first strip of durable plastic, the first strip of durable plastic having a length and a width, each of the first plurality of recesses extending across a portion of the width of the first strip, the first plurality of recesses spaced along the length of the first strip at a first distance between successive recesses of the first plurality of recesses; and affixing the first strip to the road surface such that as the car drives over the length of the first strip, the first plurality of recesses produces a first note.

In some embodiments, the method can further include preforming a second plurality of recesses into the first strip of durable plastic, each of the second plurality of recesses extending across a portion of the width of the first strip, the second plurality of recesses spaced along the length of the first strip at a second distance between successive recesses of the second plurality of recesses. The first and second pluralities of recesses can be separated from one another on the first strip.

In some embodiments the method can further include preforming a second plurality of recesses into a second strip of durable plastic, the second strip of durable plastic having a second length and a second width, each of the second plurality of recesses extending across a portion of the second width of the second strip, the second plurality of recesses spaced along the second length of the second strip at a second distance between successive recesses of the second plurality of recesses; and affixing the second strip to the road surface in an end to end fashion with the first strip such that as the car drives over the length of the second strip, the second plurality of recesses produces a second note.

Thus, although there have been described particular embodiments of the present invention of a new and useful APPARATUS AND METHOD FOR CREATING A MUSICAL ROAD, it is not intended that such references be construed as limitations upon the scope of this invention.

What is claimed is:

1. An apparatus for creating a plurality of notes as a car drives over the apparatus on a road surface at an anticipated speed, the apparatus comprising:

a strip of durable material having a strip length and a strip width;

a first plurality of recesses defined in the strip and extending along a first length, each of the first plurality of recesses extending across a portion of the strip width, the first length being correlated to a first duration of time for the car to pass over the first plurality of recesses at the anticipated speed; and a second plurality of recesses defined in the strip and extending along a second length, each of the second plurality of recesses extending across a portion of the strip width, the second length being correlated to a second duration of time for the car to pass over the second plurality of recesses at the anticipated speed;

such that when the strip is placed on the road surface and the car drives over the strip length, the first plurality of recesses are spaced along the first length a first distance from one another, such that the first plurality of recesses produce a first note having a first pitch for the first duration of time, and the second plurality of recesses are spaced along the second length a second distance from one another, such that the second plurality of recesses produce a second note having a second pitch for the second duration of time.

2. The apparatus of claim 1, wherein the first pitch is different from the second pitch.

3. The apparatus of claim 1, wherein the first and second notes correspond to different notes on a diminished fifth interval.

4. The apparatus of claim 1, wherein:

the strip has a thickness; and the first plurality of recesses is a plurality of apertures, each aperture extending through a thickness of the strip.

5. The apparatus of claim 1, wherein the strip is made of a flexible durable polymer material.

6. The apparatus of claim 1, wherein the first plurality of recesses and the second plurality of recesses are spaced apart from one another along the strip length by a resting spacing.

7. The apparatus of claim 1, wherein the first and second plurality of recesses are alternatingly repeated along the strip length such that alternating first and second notes are produced when the first strip is placed on the road surface and the car drives over the strip length at the anticipated speed.

8. The apparatus of claim 1, wherein the strip includes a bottom side, and the apparatus further comprises an adhesive layer disposed on the bottom side of the strip.

9. The apparatus of claim 8, wherein the adhesive layer comprises a removable non-destructive adhesive.

10. An apparatus for creating a series of notes as a car drives over the apparatus on a road surface at an anticipated speed, the apparatus comprising:

a first strip having a first strip length and a first strip width;

a first plurality of recesses defined in the first strip and extending along a first length, each of the first plurality of recesses extending across a portion of the first strip width, the first length being correlated to a first duration of time for the car to pass over the first plurality of recesses at the anticipated speed, wherein the first plurality of recesses are spaced along the first length at a first distance between successive recesses, such that the first plurality of recesses produce a first note having a first pitch for the first duration of time when the first strip is placed on the road surface and the car drives over the first strip length;

a second strip having a second strip length and a second strip width; and a second plurality of recesses defined in the second strip and extending along a second length, each of the second plurality of recesses extending across a portion of the second strip width, the second length being correlated to a second duration of time for the car to pass over the second plurality of recesses at the anticipated speed, wherein the second plurality of recesses are spaced along the second length at a second distance between successive recesses, such that the second plurality of recesses produce a second note having a second pitch for the second duration of time when the second strip is placed on the road surface and the car drives over the second strip length.

11. The apparatus of claim 10, wherein the first pitch is different from the second pitch.

12. The apparatus of claim 10, wherein the first and second strips are affixable to the road surface in an end-to-end fashion.

13. The apparatus of claim 10, wherein the first plurality of recesses and the second plurality of recesses are spaced apart from one another by a resting spacing.

14. The apparatus of claim 10, wherein the first and second strips include a bottom side, and the apparatus further comprises an adhesive layer disposed on the bottom side of each of the first and second strips.

15. The apparatus of claim 10, wherein the first and second notes correspond to different notes on a diminished fifth interval.

16. A method of creating a plurality of notes as a car drives over a road surface at an anticipated speed, the method comprising the steps of:

preforming at least first and second pluralities of recesses into a strip of durable material, the strip of durable material having a strip length and a strip width, the first plurality of recesses extending along a first length being correlated to a first duration of time for the car to pass over the first plurality of recesses at the anticipated speed, the second plurality of recesses extending along a second length being correlated to a second duration of time for the car to pass over the second plurality of recesses at the anticipated speed, each of the first and second pluralities of recesses extending across a portion of the strip width, the first plurality of recesses spaced along the first length at a first distance between successive recesses of the first plurality of recesses the second plurality of recesses spaced along the second length at a second distance between successive recesses; and affixing the first strip to the road surface such that as the car drives over the strip length at the anticipated speed, the first plurality of recesses produces a first note having a first pitch for the first duration of time, and the second plurality of recesses produces a second note having a second pitch for the second duration of time.

17. The method of claim 16, wherein the first pitch is different from the second pitch.

18. The method of claim 16, wherein the first and second pluralities of recesses are separate from one another on the strip.

19. The method of claim 16, wherein the first and second notes correspond to different notes on a diminished fifth interval.

20. The method of claim 16, wherein the first and second pluralities of recesses are intermingled with one another along the strip length.

* * * * *